US008421696B2

(12) United States Patent
Lin et al.

(10) Patent No.: US 8,421,696 B2
(45) Date of Patent: Apr. 16, 2013

(54) DUAL POLARIZATION ANTENNA STRUCTURE, RADOME AND DESIGN METHOD THEREOF

(75) Inventors: Hung Hsuan Lin, Taipei (TW); Chun Yih Wu, Taichung (TW); Ken Huang Lin, Kaohsiung (TW); Hsin Lung Su, Kaohsiung (TW); Hung Chi Huang, Chaozhou Town (TW)

(73) Assignees: Industrial Technology Research Institute, Chutung, Hsinchu (TW); National Sun Yat-Sen University, Kaohsiung (TW)

( * ) Notice: Subject to any disclaimer, the term of this patent is extended or adjusted under 35 U.S.C. 154(b) by 484 days.

(21) Appl. No.: 12/690,722

(22) Filed: Jan. 20, 2010

(65) Prior Publication Data

US 2010/0225563 A1 Sep. 9, 2010

(30) Foreign Application Priority Data

Mar. 4, 2009 (TW) ..... 98106931 A

(51) Int. Cl.
*H01Q 15/02* (2006.01)
*H01Q 19/09* (2006.01)
*H01Q 21/24* (2006.01)

(52) U.S. Cl.
USPC ..... 343/756; 343/872; 343/909

(58) Field of Classification Search ..... 343/756, 343/872, 909
See application file for complete search history.

(56) References Cited

U.S. PATENT DOCUMENTS

| | | | | |
|---|---|---|---|---|
| 4,684,954 | A * | 8/1987 | Sureau et al. | 343/909 |
| 6,252,559 | B1 | 6/2001 | Donn | |
| 6,885,355 | B2 | 4/2005 | Killen et al. | |
| 7,639,207 | B2 * | 12/2009 | Sievenpiper et al. | 343/909 |
| 2004/0008145 | A1 | 1/2004 | Killen et al. | |
| 2008/0001843 | A1 | 1/2008 | Wu et al. | |
| 2008/0129626 | A1 | 6/2008 | Wu et al. | |

OTHER PUBLICATIONS

Chinese Office Action issued on Aug. 8, 2012 for the Chinese counterpart application.
English Translation of Chinese Office Action issued on Aug. 8, 2012 for the Chinese counterpart application.
Ben A. Munk, "Frequency Selective Surfaces: Theory and Design", A Wiley Interscience Publication, 2000, pp. 1, 14, 26-28, 35-37, 227-229, 240-255, 10/43, John Wiley & Sons, Inc., USA.

* cited by examiner

*Primary Examiner* — Michael C Wimer
(74) *Attorney, Agent, or Firm* — Egbert Law Offices, PLLC

(57) ABSTRACT

A dual polarization antenna radome includes a plurality of dielectric substrates. Each dielectric substrate provides a plurality of metal totems, and the pattern of the metal totems is unchanged after the metal totems rotate by 90 degrees around the axis perpendicular to the dielectric substrate.

14 Claims, 12 Drawing Sheets

DUAL POLARIZATION ANTENNA STRUCTURE, RADOME AND DESIGN METHOD THEREOF

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present disclosure relates to a dual polarization antenna structure with radome and design method thereof, which are particularly capable of increasing gain.

2. Description of Related Art Including Information Disclosed Under 37 CFR 1.97 and 37 CFR 1.98.

The front-end circuit antenna of a wireless communication system is an essential device, and its performance affects the signal quality of the system. Currently, an antenna array is used for increasing antenna gain. The antenna directionality and gain could be increased by increasing the number of the antenna devices. However, this technology would significantly increase the feeding network's signal loss, has complicated a design of the feeding network, and needs a large volume of the entire antenna apparatus. The gain of the antenna would not increase effectively; in addition, the maintenance of the base station would be complex and expensive, and the large antenna apparatus is not suitable for small base station applications.

Traditionally, the gain and directionality of the antenna are increased by using array antenna. The metal antenna radome made of meta-material, which is constructed by periodic meta/dielectric patterns, could be configured to achieve almost zero effective refraction near the antenna operation frequency, so as to increase the directionality or gain of the antenna. The metal antenna radome made of meta-material could increase the directionality or gain of the antenna, and decrease the beam-width of antenna radiation pattern, but such antenna radome could only increase the directionality or gain in a predefined signal direction and/or polarization; thus it could not be used for dual polarization antenna. In other words, the application of such technology is limited by the type of antenna. In addition, when the antenna radome using the related arts is used for single polarization antenna, the polarization directions of the antenna and the antenna radome have to be considered. If the polarization directions are not aligned, the increment of the directionality or gain would be decreased.

Therefore, the present disclosure proposes a dual polarization antenna radome with higher antenna gain and lower thicknesses of the antenna and antenna radome.

BRIEF SUMMARY OF THE INVENTION

The disclosure provides a dual polarization antenna structure, antenna radome and the method thereof for increasing antenna gain and decreasing the height of the entire antenna structure.

An exemplary embodiment of the disclosure, a dual polarization antenna radome includes a plurality of dielectric substrates, wherein each of the plurality of dielectric substrates has a surface including a plurality of metal patterns arranged in the form of an array, and the metal patterns are substantially unchanged after rotating 90 degrees around an axis perpendicular to the dielectric substrate. Moreover, the obtained antenna performance is similar at both perpendicular directions according to the present disclosure.

Another exemplary embodiment of the disclosure, a dual polarization antenna structure includes an antenna and the above-mentioned antenna radome. The distance between the antenna and the antenna radome is less than or equal to 1/10th of the wavelength corresponding to the operation frequency.

Another exemplary embodiment of the disclosure, a method for constructing a dual polarization antenna structure includes the steps of analyzing refraction, transmission and impedance of metal patterns of an antenna radome; determining the metal patterns according to the analyses; and arranging the metal patterns in the form of an array on dielectric substrates of the antenna radome.

DETAILED DESCRIPTION OF THE INVENTION

The present disclosure can be explained with the appended drawings to clearly disclose the technical characteristics of the present disclosure.

Figure 1:
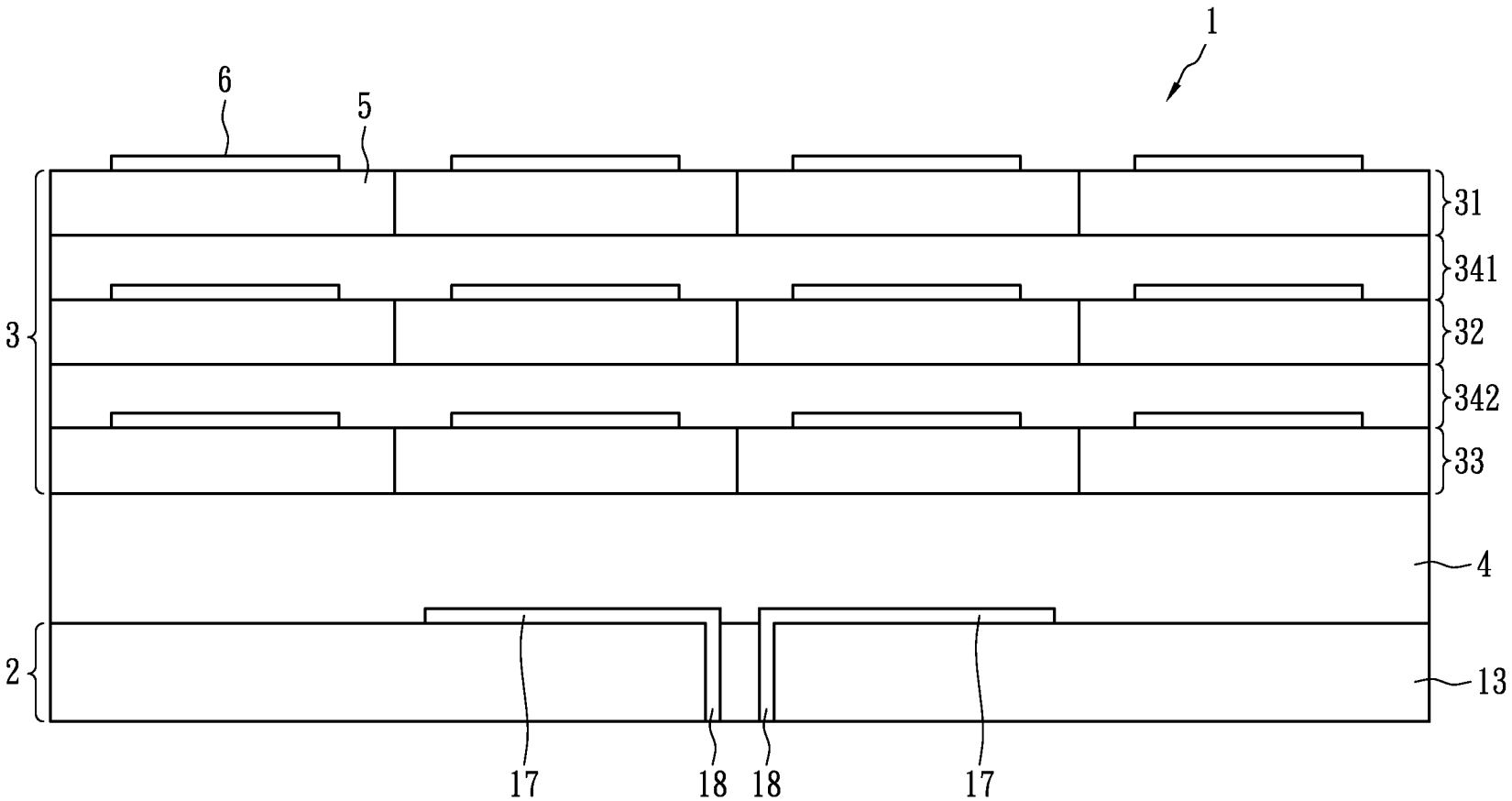
FIG. 1 illustrates a side cross-sectional view of a dual polarization antenna in accordance with an embodiment of the present disclosure.

FIG. 1 illustrates a side view of a dual polarization antenna structure 1 in accordance with an embodiment of the present disclosure. The dual polarization antenna structure 1 includes an antenna 2, at least one dielectric substrate layer 4 and an antenna radome 3. The distance between the antenna 2 and the antenna radome 3 is less than or equal to 1/10th of the wavelength corresponding to the operation frequency.

The antenna radome of the present disclosure, unlike that of the Fabry Perot design, is not limited by need of a grounding surface, and thus the application to a dipole antenna is exemplified below. The antenna 2 is a dipole antenna and includes two radiation conductors 17 on a substrate 13 and antenna feeding terminals 18 coupled to the radiation conductors 17. A dielectric substrate layer 4 is disposed on the antenna 2, and may be an air gap. The antenna radome 3 is disposed on the dielectric substrate layer 4 and includes a plurality of dielectric substrates 31, 32 and 33. There is a gap 341 between the dielectric substrate 31 and the dielectric substrate 32, and a gap 342 is formed between the dielectric layer 32 and the dielectric layer 33. The gaps 341 and 342 may be vacuums, or may include air or other dielectric materials. Each of the dielectric substrates 31, 32 and 33 is constituted of a plurality of array cell dielectric substrates 5, and the surface of the array cell dielectric substrate 5 includes metal pattern or metal totem 6. In an embodiment, the gap 341 or 342 has a preferred thickness of 1.6 mm. In a case of normalizing the wavelengths of a central frequency of 3.5 GHz, the size of the gap 341 or 342 is preferably 1.6/85 of the wavelength. The gap may be, but is not limited to, air or vacuum. The user could use proper materials as desired to obtain optimal dielectric constant, permeability and conductivity for achieving better antenna performance.

In general, the dielectric substrate layer 4 (which may be plural layers having different dielectric characteristic) is used for generating a distance between the antenna 2 and the antenna radome 3, and the user could adjust the distance for better antenna receiving and transmitting performance. In addition to air, the dielectric substrate layer 4 may be vacuum, $FR_4$, $SiO_2Al_2O_3$ etc. The material of the dielectric substrate layer 4 is not limited and could be selected as desired to configure for effective optimal dielectric constant, permeability and permittivity for better antenna performance. In this embodiment, the distance between the antenna 2 and the antenna radome 3 is 4 mm. In a case of normalizing the wavelengths of a central frequency of 3.5 GHz, the distance is preferably 4/85 of the wavelength or less than or equal to 1/10 of the wavelength. Likewise, the material or thickness of the dielectric substrate layer 4 is exemplified only, and the user could use different material and thickness for different operation frequency, so as to obtain better receiving and transmitting performance.

Figure 2:
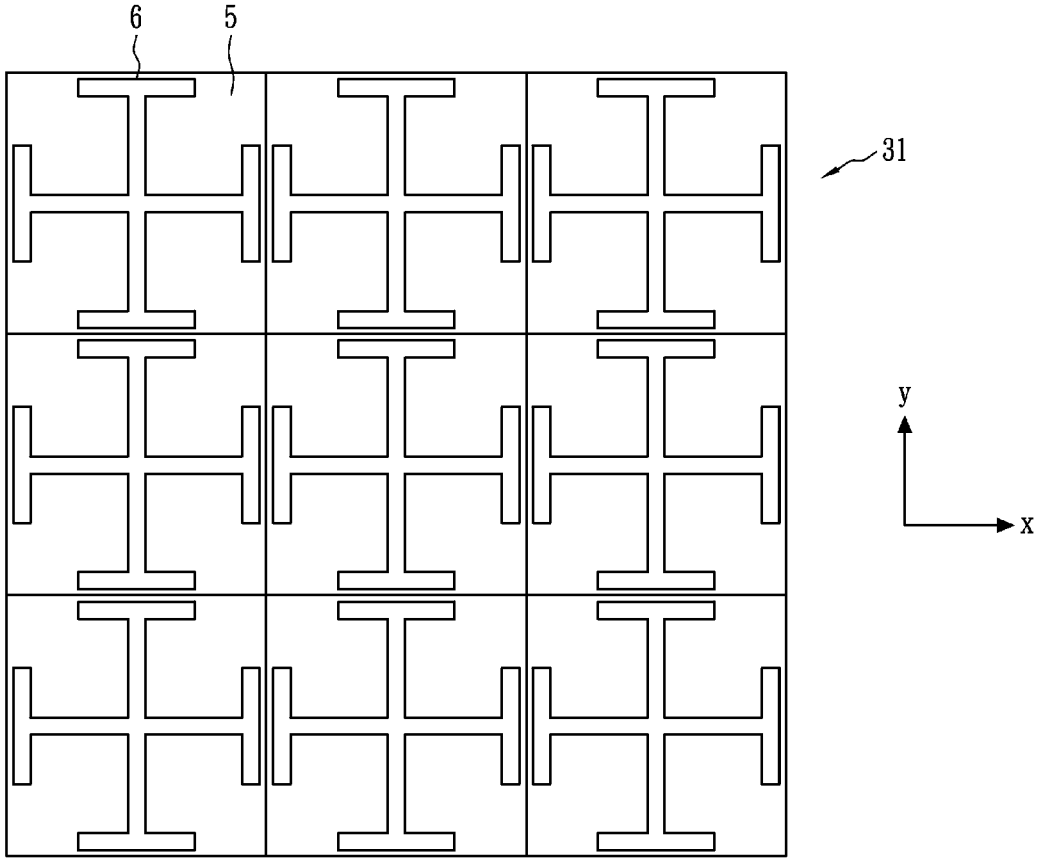
FIG. 2 illustrates a schematic view of a dielectric substrate in accordance with an embodiment of the present disclosure.

FIG. 2 illustrates the dielectric substrate 31 comprised of a plurality of array cell dielectric substrates 5. The dielectric substrates 32 and 33 may be the same structure. In an embodiment, the dielectric substrate 31, the dielectric substrate 32 and the dielectric substrate 33 are comprised of a 3×3 array including nine array cell dielectric substrates 5. In practice, the metal patterns 6 could be arranged in the form of an m×n array, where m and n are positive integers. The number of the array cell substrates 5 is not limited. The sizes of the array cell dielectric substrates 5 are the same, and the material of the array cell dielectric substrates 5 is also not limited. The user could select any suitable material as desired to design effective optimal dielectric constant, permeability and permittivity for achieving better receiving and transmitting performance. In this embodiment, the length and width of the array cell dielectric substrate 5 are each 23 mm, and the thickness is between 0.3 and 2 mm, e.g., 0.8 mm. In a case of normalizing the wavelengths of a central frequency of 3.5 GHz, the length and width of the array cell dielectric substrate 5 are 23/85 of the wavelength, and the thickness thereof is 0.8/85 of the wavelength. In addition to the above description relating to the length and width of array cell dielectric substrate 5, the user could use different length, width and thickness for different operation frequency, so as to obtain better antenna receiving and transmitting performance.

The metal pattern or metal totem 6 on the dielectric substrate 31, 32 or 33 is symmetrical along x and y directions. Therefore, the metal totem 6 is substantially unchanged after the dielectric substrate 31, 32 or 33 rotates around the axis perpendicular to the center of the dielectric substrate 31, 32 or 33 by 90 degrees. In other words, the surface of each of the dielectric substrate 31, 32 or 33 includes a plurality of metal totems 6 arranged in the form of an array, and the metal totems 6 are unchanged when the metal totems 6 rotate 90 degrees around an axis perpendicular to the dielectric substrate 31, 32 or 33. Accordingly, the antenna structure of the present disclosure has dual polarization characteristics.

Figure 3:
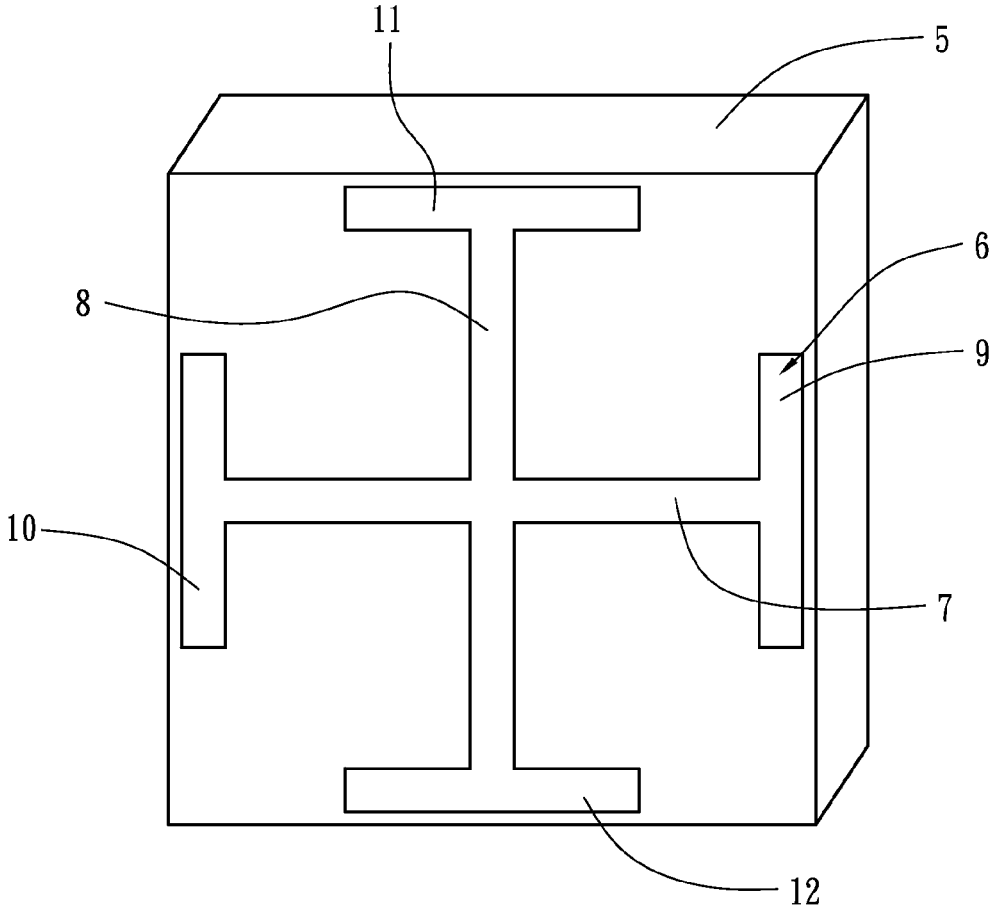
FIG. 3 illustrates a schematic view of a single array cell dielectric substrate of the present disclosure.

FIG. 3 illustrates the metal totem 6 on the array cell dielectric layer 5. In this embodiment, the metal totem 6 includes a first metal arm 7, a second metal arm 8, a first appended metal arm 9, a second appended metal arm 10, a third appended metal arm 11 and a fourth appended metal arm 12. The first metal arm 7 and the second metal arm 8 are crossed and substantially perpendicular to each other. The first appended metal arm 9 is connected to an end of the first metal arm 7 and is substantially parallel to the second metal arm 8. The second appended metal arm 10 is connected to the other end of the first metal arm 7 and is substantially parallel to the second metal arm 8. The third appended metal arm 11 is connected to an end of the second metal arm 8 and is substantially parallel to the first metal arm 7. The fourth appended metal arm 12 is connected to the other end of the second metal arm 8, and is substantially parallel to the first metal arm 7. The metal totem 6 is of a double crossed-I pattern. The size or dimension of the metal totem 6 is not limited; as long as it does not exceed the array cell dielectric substrate 5, the user could adjust the size as desired. Like the symmetrical structure shown in FIG. 2, the metal totem 6 is substantially unchanged after rotating 90 degrees around the axis perpendicular to the array cell dielectric substrate 5. In an embodiment, the dielectric substrate 5 may be made of $FR_4$ with a dielectric constant of 4.4, the lengths of the first metal arm 7 and the second metal arm 8 are 20 mm, and the widths thereof are preferably 2.5 mm. The lengths of the first appended metal arm 9, the second appended metal arm 10, the third appended metal arm 11 and the fourth appended metal arm 12 are 19 mm, and the widths thereof may be 2.5 mm. The gap between the metal totems 6 is 1 mm. In a case of normalizing the wavelengths of a central frequency of 3.5 GHz, the lengths of the first metal arm 7 and the second metal arm 8 are 20/85 of the wavelength, and the widths thereof are 2.5/85 of the wavelength. The lengths of the first appended metal arm 9, the second appended metal arm 10, the third appended metal arm 11 and the fourth appended metal arm 12 are 19/85 of the wavelength, and the widths thereof are 2.5/85 of the wavelength. The size of the gap of the metal totems 6 is 1/85 of the wavelength. The above metal totems 6 of various dimensions are exemplified only, and the user could utilize different length, width and gap for different operation frequency, so as to obtain better antenna performance. Moreover, the dielectric substrate 5 serves as a carrier for the metal totem 6, and the metal totem 6 is the actual operation device. Many dielectric substrates 5 could be formed as an integrated substrate structure. If the metal totem 6 could be supported in another way to have the same 3-dimensional structure, the dielectric substrate 5 may be omitted or replaced.

Figure 4:
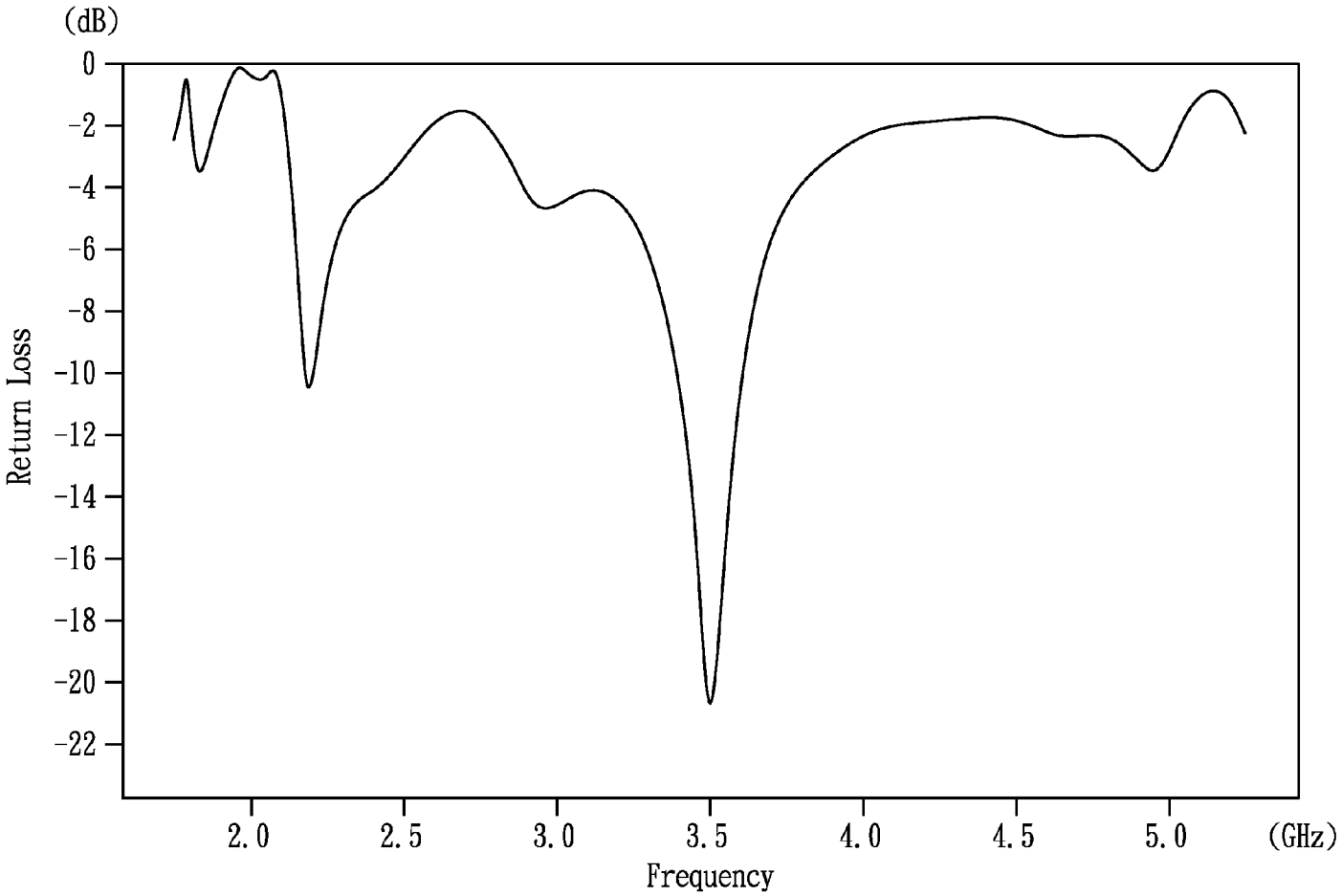
FIG. 4 is a graphical view of return loss vs. frequency of the dual polarization antenna of the present disclosure.

FIG. 4 illustrates a simulation diagram of return loss vs. frequency of the antenna in accordance with an embodiment of the present disclosure. The minimum return loss is at the frequency of approximately 3.5 GHz.

Figure 5:
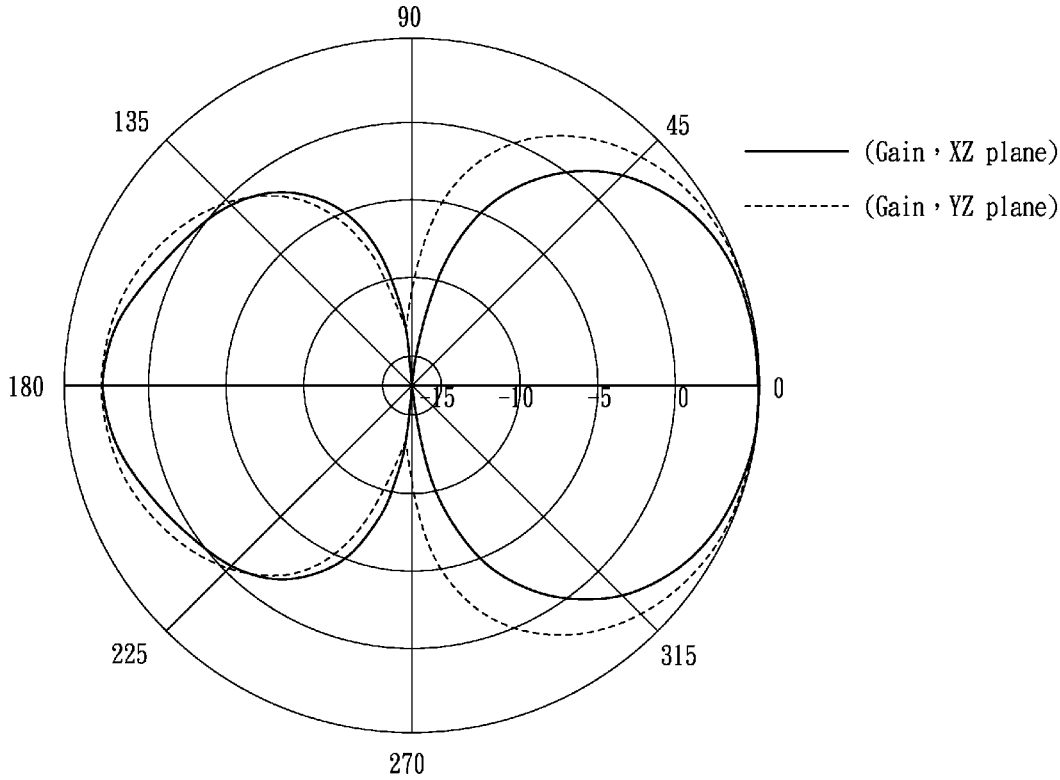
FIG. 5 illustrates a schematic view of a radiation pattern of an embodiment of the present disclosure.

FIG. 5 illustrates a simulated radiation pattern of the dual polarization antenna structure having a radome with higher gain. The gain of 5.3 dB could be observed around the central frequency 3.5 GHz, and is greater than the original dipole antenna by 3.5 dB.

Figure 6:
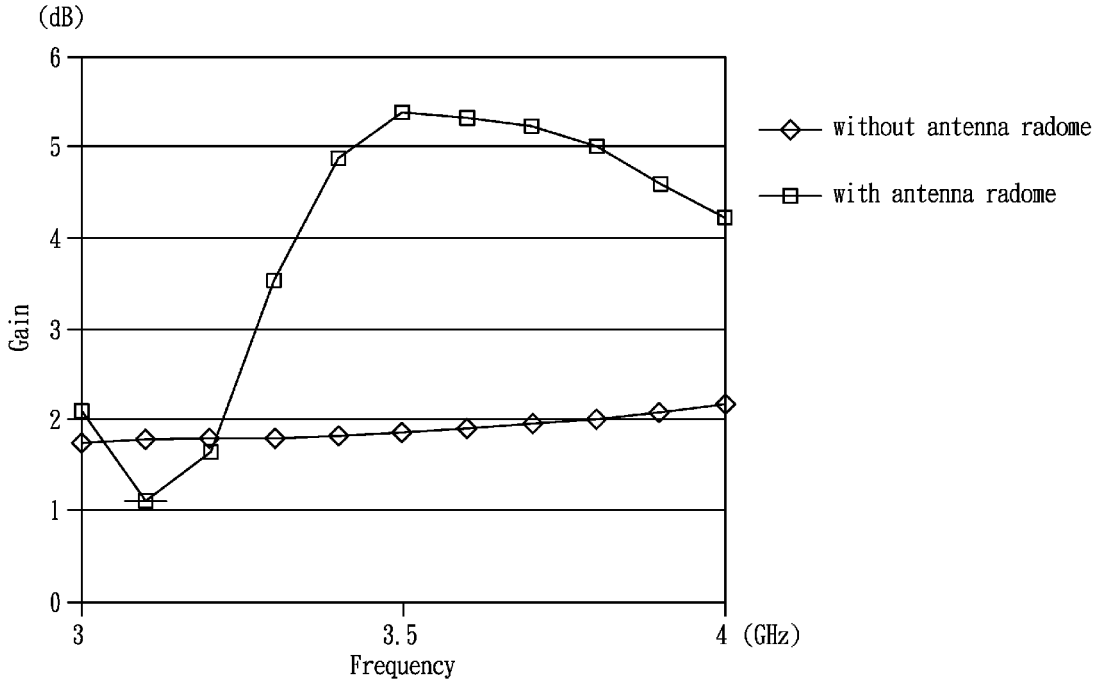
FIG. 6 is a graphical view of gain above the antenna vs. frequency of the dual polarization antenna structure with and without antenna radome in accordance with an embodiment of the present disclosure.

FIG. 6 illustrates a simulation diagram of gain above the antenna vs. frequency of the dipole antenna structure with and without antenna radome in accordance with an embodiment of the present disclosure. It could be seen that the antenna radome could effectively increase gain at the operation frequency of approximately 3.5 GHz.

Figure 7:
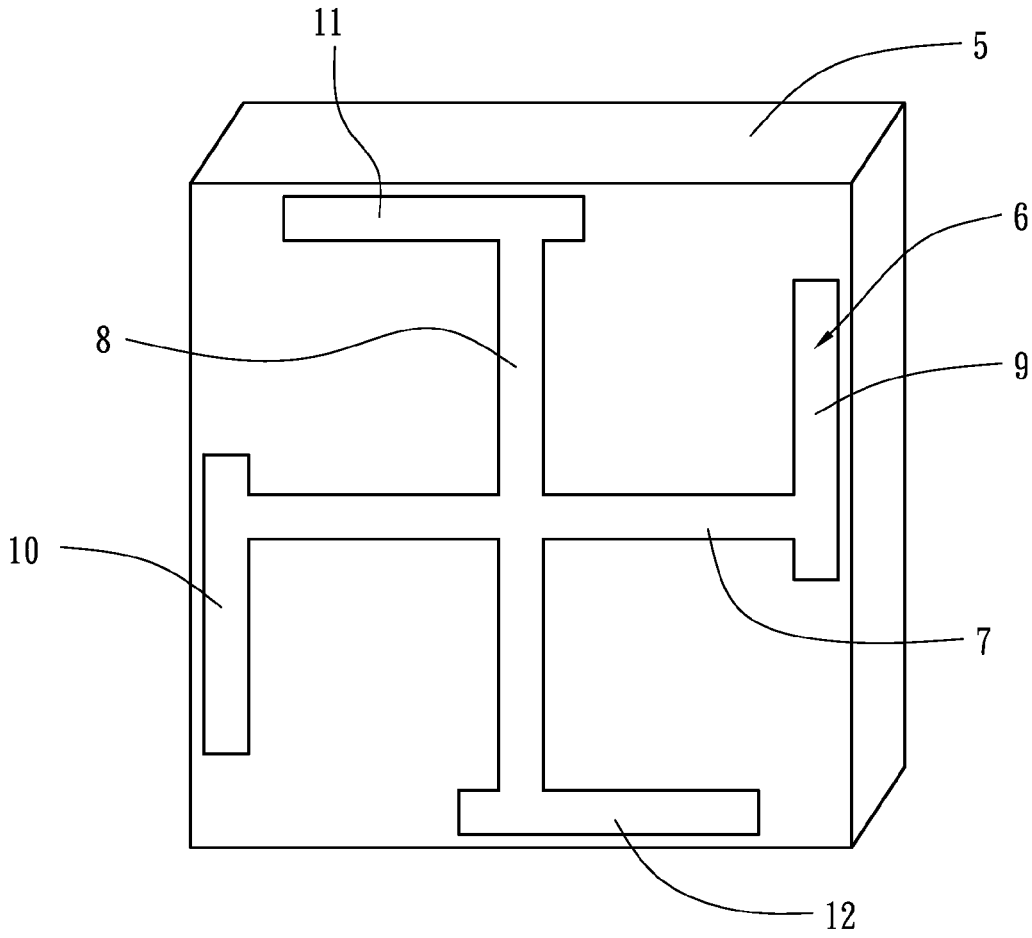
FIG. 7 illustrates a schematic view of a single array cell dielectric substrate according to another embodiment of the present disclosure.

In addition to the double crossed-I pattern shown in FIG. 3, the metal totem 6 may use the pattern illustrated in FIG. 7. Like FIG. 3, the first metal arm 7 and the second metal arm 8 are crossed and perpendicular to each other, the appended metal arms 9 and 10 are parallel to the second metal arm 8, and the appended metal arms 11 and 12 are parallel to the first metal arm 7. The difference is that the two sides of each of the appended metal arms 9 and 10 connecting to the first metal arm 7 are asymmetrical, i.e., one side is longer and the other side is shorter. Nevertheless, the metal totem 6 is substantially unchanged after rotating 90 degrees around the axis perpendicular to the array cell dielectric substrate 5, and thus the antenna retains dipole feature.

The present disclosure also could be implemented in a patch antenna, and is exemplified below.

Figure 8:
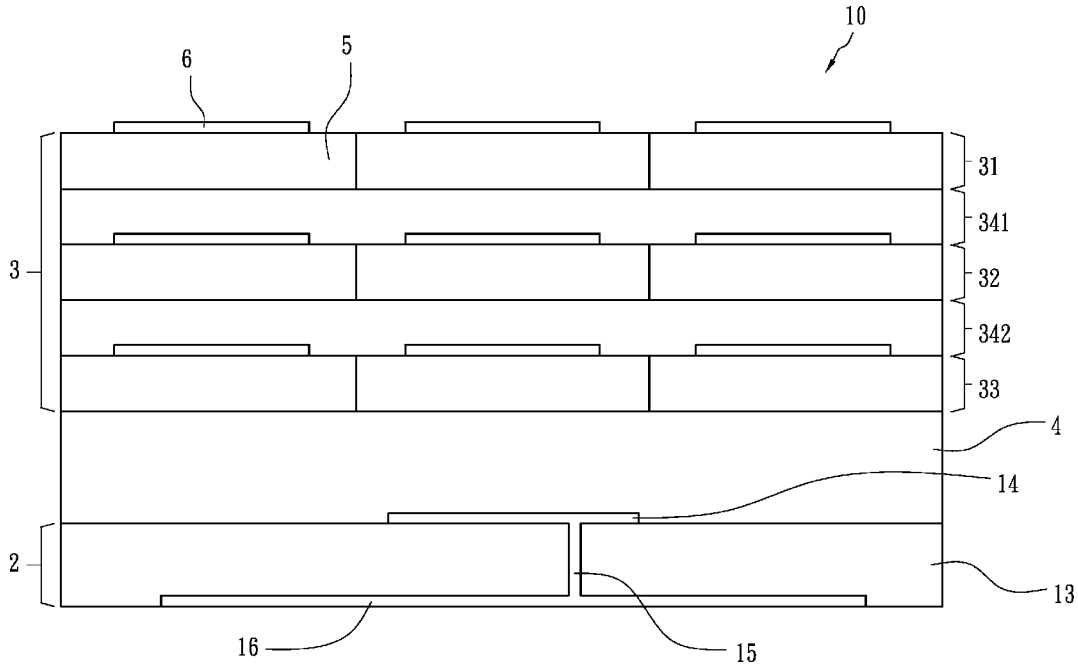
FIG. 8 illustrates a side cross-sectional view of a dual polarization antenna in accordance with another embodiment of the present disclosure.

FIG. 8 illustrates a dual polarization antenna structure 10, and except for the use of the patch antenna, the structure is equivalent to that shown in FIG. 1. An antenna 2 includes a substrate 13, a radiation conductor 14 on the surface of the substrate 13, a feeding end 15 coupled to the first radiation conductor 14, and a ground 16 coupled to the feeding end 15.

Figure 9:
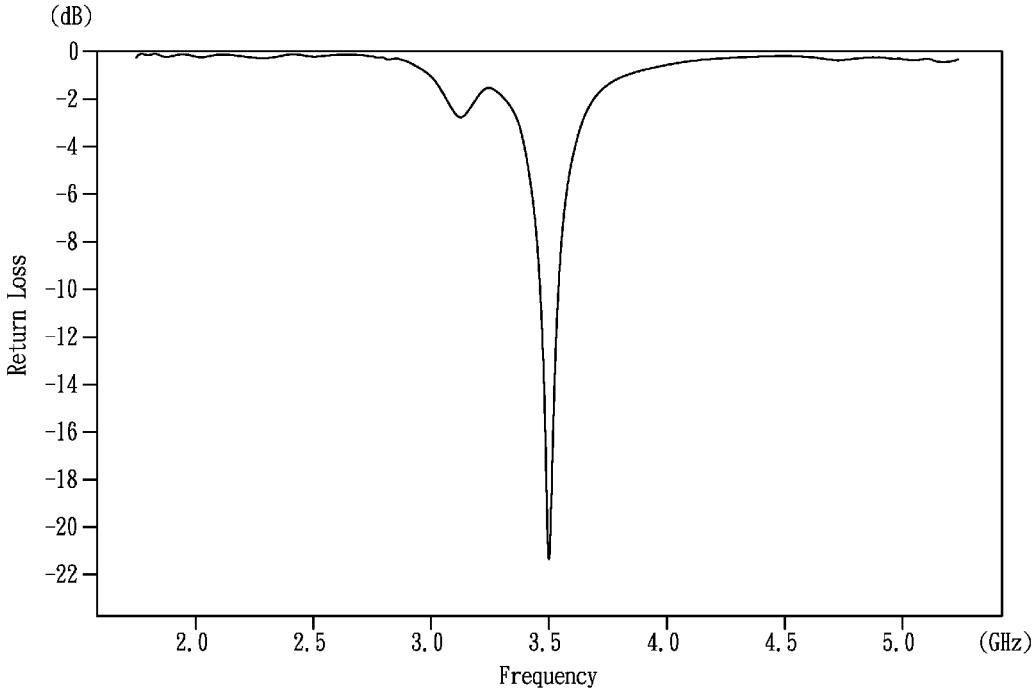
FIG. 9 is a graphical view of return loss vs. frequency of the antenna according to another embodiment of the present disclosure.

FIG. 9 illustrates a simulation diagram of return loss vs. frequency of the antenna in accordance with an embodiment. The minimum return loss is at the frequency of approximately 3.5 GHz.

Figure 10:
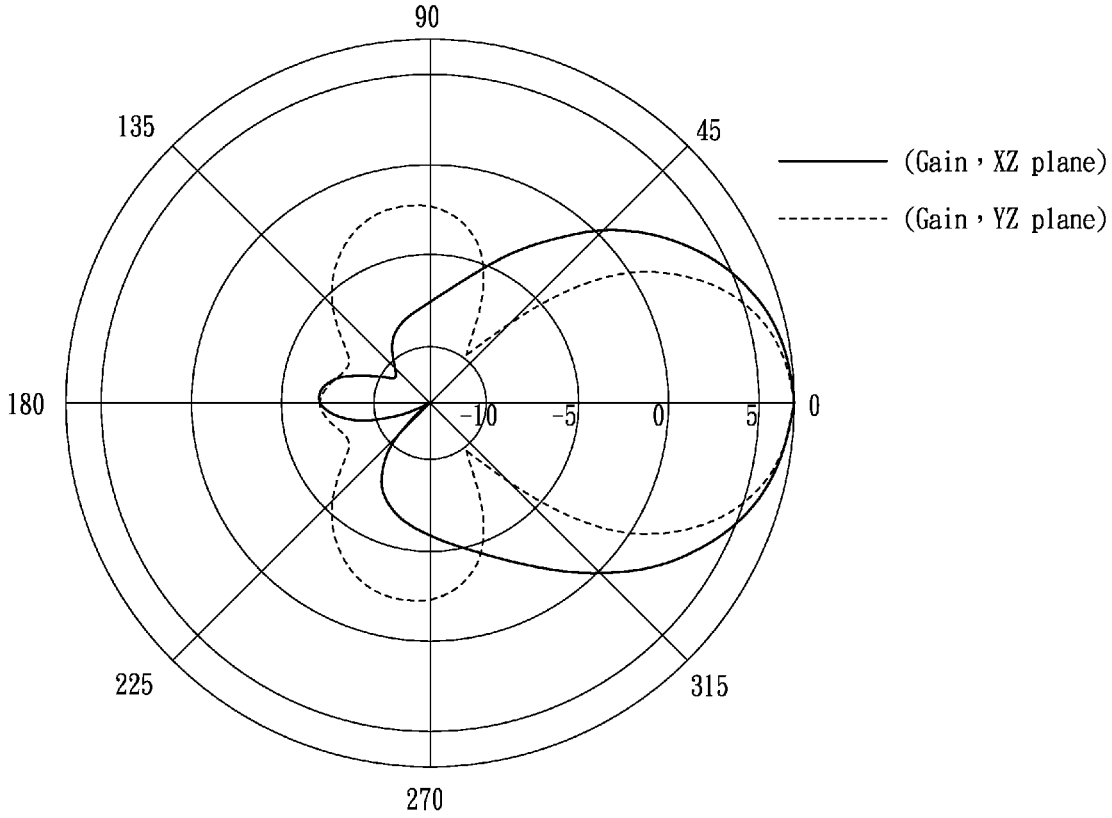
FIG. 10 illustrates a schematic view of a radiation pattern of another embodiment of the present disclosure.

FIG. 10 illustrates a simulated radiation pattern of the antenna structure in accordance with an embodiment of the present disclosure. The gain could be effectively increased at the central frequency of approximately 3.5 GHz.

Figure 11:
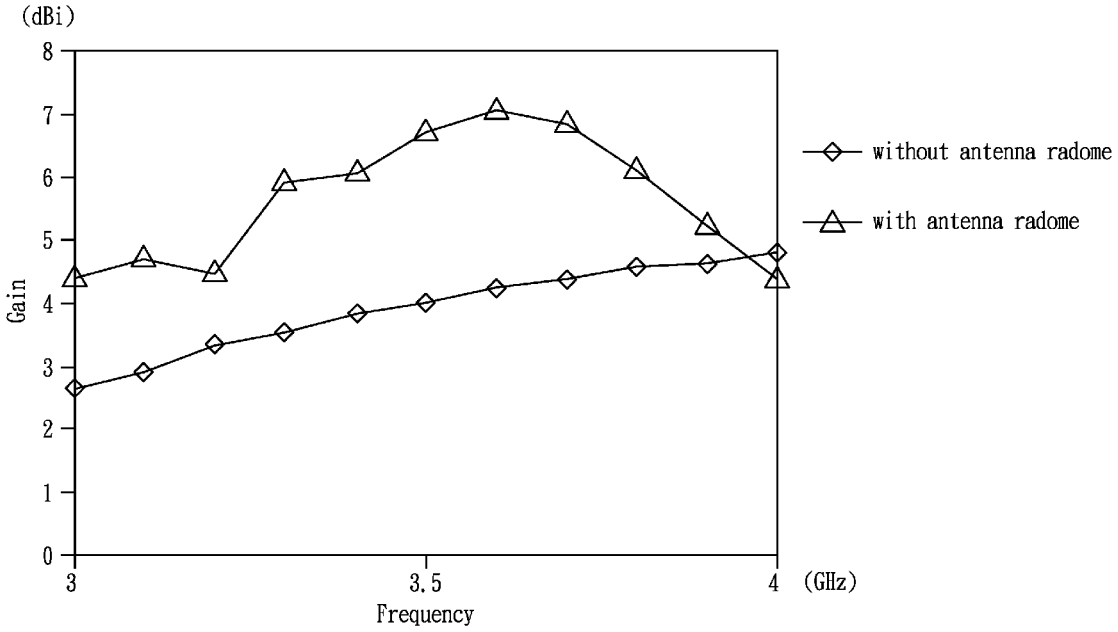
FIG. 11 illustrates a graphical view of gain above the antenna vs. frequency of the dual polarization antenna structure with and without antenna radome in accordance with another embodiment of the present disclosure.

FIG. 11 illustrates a simulation diagram of gain above the antenna vs. frequency of the patch antenna structure with and without antenna radome in accordance with an embodiment of the present disclosure. It could be seen that the antenna radome could effectively increase gain at the operation frequency of approximately 3.5 GHz.

Figure 12:
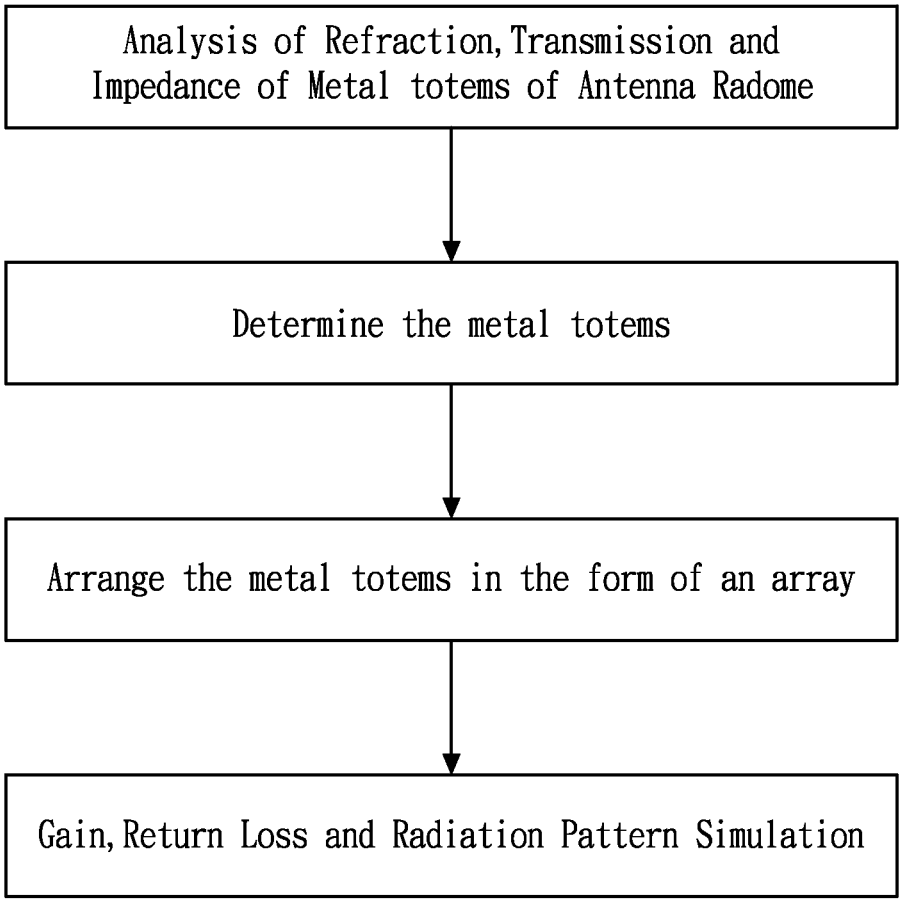
FIG. 12 illustrates the method of the dual polarization antenna structure of the present disclosure.

As shown in FIG. 12, the dual polarization antenna structure could be configured as follows. First, refraction, transmission and impedance of the metal totems of the antenna radome are analyzed. The metal totem and the optimal height of the antenna radome are determined according to the analysis. The metal totems are arranged in the form of an array on the dielectric substrates of the antenna radome, and as a result the entire antenna structure is completed. Then, the antenna structure is subjected to gain, return loss and radiation pattern simulation for further verifications.

In view of the above, both the dual polarization antenna structures 1 and 10 could increase the directionality and gain in two different polarization directions, so that they could be applied to dual polarization antenna to increase directionality and gain in two polarization directions. In the case of being applied to a single polarization antenna, it is not necessary to consider the alignment problem of the polarization direction of the single polarization antenna and the polarization direction of antenna radome for increasing gain. Therefore, the present disclosure could increase receiving and transmitting performance of the antenna significantly.

Given the above, the present disclosure proposes a dual polarization antenna radome constituted of metal patterns or totems, dielectric substrate layers and array cell dielectric substrates, which could increase directionality and gain thereof.

The above-described embodiments of the present disclosure are intended to be illustrative only. Numerous alternative embodiments may be devised by those skilled in the art without departing from the scope of the following claims.

We claim:

1. A dual polarization antenna structure comprising:

a dual polarization antenna; and an antenna radome comprising a plurality of dielectric substrates, wherein each of the plurality of dielectric substrates has a surface comprising a plurality of metal patterns arranged in the form of an array, the metal patterns are substantially unchanged after rotating 90 degrees around an axis perpendicular to the dielectric substrates, wherein an operation frequency of the dual polarization antenna is within a range of frequencies and wherein a distance between the dual polarization antenna and the antenna radome is less than or equal to 1/10 of a wavelength corresponding to the operation frequency.

2. The dual polarization antenna structure of claim 1, wherein the metal pattern comprises a double crossed-I pattern.

3. The dual polarization antenna structure of claim 1, wherein the metal patterns are metal totems each comprising:

a first metal arm;

a second metal arm crossing and substantially perpendicular to the first metal arm;

a first appended metal arm connected to an end of the first metal arm and substantially parallel to the second metal arm;

a second appended metal arm connected to another end of the first metal arm and substantially parallel to the second metal arm;

a third appended metal arm connected to an end of the second metal arm and substantially parallel to the first metal arm; and a fourth appended metal arm connected to another end of the second metal arm and substantially parallel to the first metal arm.

4. The dual polarization antenna structure of claim 1, wherein the plurality of metal patterns are arranged in an m×n array, where m and n are positive integers.

5. The dual polarization antenna structure of claim 1, wherein each of the dielectric substrates comprises a plurality of array cell dielectric substrates, and each of the array cell dielectric substrates has a surface comprising the metal pattern.

6. The dual polarization antenna structure of claim 5, wherein the metal pattern is substantially unchanged after rotating 90 degrees around an axis perpendicular to the array cell dielectric substrate.

7. The dual polarization antenna structure of claim 1, wherein the plurality of dielectric substrates comprise gaps therebetween.

8. The dual polarization antenna structure of claim 7, wherein the gaps between the dielectric substrates is vacuum or air.

9. The dual polarization antenna structure of claim 1, wherein the metal patterns are formed by printing or etching.

10. The dual polarization antenna structure of claim 1, wherein the dual polarization antenna is a dipole antenna or patch antenna.

11. The dual polarization antenna structure of claim 1, wherein a dielectric substrate layer is formed between the antenna and the antenna radome.

12. The dual polarization antenna structure of claim 11, wherein the dielectric substrate layer is vacuum or air.

13. A method for constructing a dual polarization antenna structure comprising the steps of:

analyzing refraction of metal patterns of an antenna radome;

analyzing transmission of the metal patterns of the antenna radome;

analyzing impedance of the metal patterns of the antenna radome;

determining the metal patterns according to the analyses;

arranging the metal patterns as an array on dielectric substrates of the antenna radome; and stimulating gain and return loss and radiation pattern when the antenna radome is configured with a dual polarization antenna, wherein an operation frequency of the dual polarization antenna is selected to be within a range of frequencies and wherein a distance between the dual polarization antenna and the antenna radome is selected to be less than or equal to 1/10 of a wavelength corresponding to the operation frequency.

14. The method for constructing the dual polarization antenna structure of claim 13, wherein the metal patterns are substantially unchanged after rotating 90 degrees around an axis perpendicular to the dielectric substrate.

* * * * *